US009452325B2

(12) United States Patent
DeShiell et al.

(10) Patent No.: US 9,452,325 B2
(45) **Date of Patent: *Sep. 27, 2016**

(54) GOLF CLUB HEAD HAVING A COMPOSITE CROWN

(71) Applicant: Taylor Made Golf Company, Inc., Carlsbad, CA (US)

(72) Inventors: Drew T. DeShiell, Oceanside, CA (US); Kraig Alan Willett, Fallbrook, CA (US); Michael Scott Burnett, Carlsbad, CA (US); Benoit Vincent, Encinitas, CA (US); Joseph Henry Hoffman, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/516,503

(22) Filed: Oct. 16, 2014

(65) Prior Publication Data

US 2015/0038262 A1 Feb. 5, 2015

Related U.S. Application Data

(60) Continuation of application No. 13/973,875, filed on Aug. 22, 2013, now abandoned, which is a (Continued)

(51) Int. Cl.
*A63B 53/04* (2015.01)

(52) U.S. Cl.
CPC .... *A63B 53/0466* (2013.01); *A63B 2053/0408* (2013.01); *A63B 2053/0412* (2013.01); *A63B 2053/0437* (2013.01); *A63B 2053/0458* (2013.01); *A63B 2209/023* (2013.01)

(58) Field of Classification Search
CPC ..... A63B 53/0466; A63B 2053/0408; A63B 2053/0458; A63B 2053/0412; A63B 2053/0437; A63B 2209/023
USPC ..... 473/324–350, 287–292
See application file for complete search history.

(56) References Cited

U.S. PATENT DOCUMENTS 2,171,383 A 8/1939 Wettlaufer
2,654,608 A 10/1953 Liebers (Continued)

FOREIGN PATENT DOCUMENTS

JP 01-171583 7/1989
JP 04-292178 10/1992

(Continued)

OTHER PUBLICATIONS

Amendment (Apr. 3, 2003), U.S. Appl. No. 09/878,634, filed Jun. 11, 2001 (cited in U.S. Appl. No. 95/000,040), 10pp.

(Continued)

*Primary Examiner* — Sebastiano Passaniti
(74) *Attorney, Agent, or Firm* — Klarquist Sparkman, LLP

(57) ABSTRACT

A golf club head having a high COR that is durable and has desirable acoustic qualities. The club head includes a body portion, a striking face and a crown forming a hollow cavity of at least 150 cc in volume. The body portion defines a front opening and an upper opening, and it includes a sole and a side section that extends rearward of the front opening. The striking plate is secured to the body portion, enclosing the front opening. While partially assembled, final weighting and/or other attachment of other members to the inner surface of the club head can be preformed, as desired. The crown is secured to the body portion, enclosing the upper opening. A surface veil may also be provided about a junction of the crown and body. The crown has a maximum thickness no greater than about 2 mm. The density of the crown is less than the density of the body portion. At least one of the striking plate and the crown is attached to the second portion by adhesive bonding, and the golf club head has a maximum coefficient of restitution of at least 0.80.

20 Claims, 8 Drawing Sheets

Related U.S. Application Data continuation of application No. 13/653,298, filed on Oct. 16, 2012, now Pat. No. 8,568,248, which is a continuation of application No. 13/349,494, filed on Jan. 12, 2012, now Pat. No. 8,287,402, which is a continuation of application No. 12/975,116, filed on Dec. 21, 2010, now Pat. No. 8,096,896, which is a division of application No. 11/775,197, filed on Jul. 9, 2007, now Pat. No. 7,854,364, which is a continuation-in-part of application No. 10/316,453, filed on Dec. 11, 2002, now abandoned.

(56) References Cited

U.S. PATENT DOCUMENTS

| | | | | |
|---|---|---|---|---|
| 4,021,047 | A | 5/1977 | Mader | |
| 4,214,754 | A | 7/1980 | Zebelean | |
| 4,438,931 | A | 3/1984 | Motomiya | |
| 4,555,115 | A | 11/1985 | You | |
| 4,681,321 | A | 7/1987 | Chen et al. | |
| 4,930,781 | A | 6/1990 | Allen | |
| 5,056,705 | A | 10/1991 | Wakita et al. | |
| 5,094,383 | A | 3/1992 | Anderson et al. | |
| 5,176,383 | A | 1/1993 | Duclos | |
| 5,261,664 | A | 11/1993 | Anderson et al. | |
| 5,316,298 | A | 5/1994 | Hutin et al. | |
| 5,328,176 | A | 7/1994 | Lo | |
| 5,346,217 | A | 9/1994 | Tsuchiya et al. | |
| 5,377,986 | A | 1/1995 | Viollaz et al. | |
| 5,410,798 | A | 5/1995 | Lo | |
| 5,425,538 | A | 6/1995 | Vincent et al. | |
| 5,482,279 | A | 1/1996 | Antonious | |
| 5,533,729 | A | 7/1996 | Leu | |
| 5,547,427 | A | 8/1996 | Rigal et al. | |
| 5,624,331 | A | 4/1997 | Lo et al. | |
| 5,665,014 | A | 9/1997 | Sanford et al. | |
| 5,669,829 | A | 9/1997 | Lin | |
| 5,709,615 | A | 1/1998 | Liang | |
| 5,735,754 | A | 4/1998 | Antonious | |
| 5,755,627 | A | 5/1998 | Yamazaki et al. | |
| 5,776,011 | A | 7/1998 | Su et al. | |
| 5,778,966 | A | 7/1998 | Hsieh | |
| 5,868,635 | A | 2/1999 | Aizawa et al. | |
| 5,873,791 | A | 2/1999 | Allen | |
| 5,888,148 | A | 3/1999 | Allen | |
| 5,967,904 | A | 10/1999 | Nagai et al. | |
| 6,162,130 | A | 12/2000 | Masumoto et al. | |
| 6,162,133 | A | 12/2000 | Peterson | |
| 6,248,025 | B1 | 6/2001 | Murphy et al. | |
| 6,280,349 | B1 | 8/2001 | Cook | |
| 6,299,547 | B1 | 10/2001 | Kosmatka | |
| 6,334,817 | B1 | 1/2002 | Ezawa et al. | |
| 6,406,381 | B2 | 6/2002 | Murphy et al. | |
| 6,435,980 | B1 | 8/2002 | Reyes et al. | |
| 6,471,604 | B2 | 10/2002 | Hocknell et al. | |
| 6,491,592 | B2 | 12/2002 | Cackett et al. | |
| 6,558,271 | B1 | 5/2003 | Beach et al. | |
| 6,575,845 | B2 | 6/2003 | Galloway et al. | |
| 6,607,623 | B2 | 8/2003 | Murphy et al. | |
| 6,623,378 | B2 | 9/2003 | Beach et al. | |
| 6,663,504 | B2 | 12/2003 | Hocknell et al. | |
| 6,872,152 | B2 | 3/2005 | Beach et al. | |
| 6,875,126 | B2 | 4/2005 | Yabu | |
| 6,902,811 | B2 * | 6/2005 | Oosedo | C08G 59/24 257/E23.119 |
| 6,945,877 | B2 | 9/2005 | Kobayashi et al. | |
| 6,955,612 | B2 | 10/2005 | Lu | |
| 6,969,326 | B2 | 11/2005 | De Shiell et al. | |
| 6,982,053 | B2 | 1/2006 | Chen | |
| 7,041,005 | B2 | 5/2006 | Beach et al. | |
| 7,214,142 | B2 | 5/2007 | Meyer et al. | |
| 7,261,646 | B2 | 8/2007 | De Shiell et al. | |
| 7,281,994 | B2 | 10/2007 | De Shiell et al. | |
| 7,494,425 | B2 | 2/2009 | De Shiell et al. | |
| 7,704,164 | B2 | 4/2010 | Beach et al. | |
| 7,854,364 | B2 | 12/2010 | De Shiell et al. | |
| 8,096,896 | B2 | 1/2012 | De Schiell et al. | |
| 8,287,402 | B2 | 10/2012 | De Shiell et al. | |
| 8,568,248 | B2 | 10/2013 | DeShiell et al. | |
| 2001/0049310 | A1 | 12/2001 | Cheng et al. | |
| 2002/0022535 | A1 | 2/2002 | Takeda | |
| 2002/0065146 | A1 | 5/2002 | Kusumoto | |
| 2002/0142859 | A1 | 10/2002 | Galloway et al. | |
| 2003/0032500 | A1 | 2/2003 | Nakahara et al. | |
| 2003/0083151 | A1 | 5/2003 | Nakahara et al. | |
| 2003/0125127 | A1 | 7/2003 | Nakahara et al. | |
| 2003/0134693 | A1 | 7/2003 | Nakahara et al. | |
| 2004/0192468 | A1 | 9/2004 | Onoda et al. | |
| 2005/0119068 | A1 | 6/2005 | Onoda et al. | |
| 2009/0036230 | A1 | 2/2009 | Beach et al. | |
| 2010/0178998 | A1 | 7/2010 | Beach et al. | |
| 2013/0040758 | A1 | 2/2013 | DeShiell et al. | |
| 2013/0337939 | A1 | 12/2013 | DeShiell et al. | |
| 2014/0038749 | A1 | 2/2014 | Beach et al. | |

FOREIGN PATENT DOCUMENTS

| | | |
|---|---|---|
| JP | 05-317465 | 12/1993 |
| JP | 07-155410 | 6/1995 |
| JP | 2002-165902 | 6/2002 |
| JP | 2003-020347 | 7/2003 |
| JP | 2003-020348 | 7/2003 |
| JP | 2004195214 | 7/2004 |
| WO | WO99/22824 | 5/1999 |

OTHER PUBLICATIONS

Bonenberger, "The First Snap-Fit Handbook: Creating Attachments for Plastic Parts," Cincinnati: Hanser Gardner Publications, Inc., p. 28 (2000).

Chung, Deborah D.L., "Carbon Fiber Composites," Elsevier, Online version available at: http://knovel.com/web/portal/browse/display?_EXT_KNOVEL_DISPLAY_bookid=517&VerticalID=0, 5 pp. (1994).

Dictionary.com/adhesive, "Get the Top 10 Most Popular Sites for 'Adhesive,'"downloaded from http://dictionary.reference.com/search?q=adhesive, 3pp. (document not dated, downloaded on Mar. 17, 2004).

Ellis, Jeffrey, "The Golf Club—Niagra Clubs," Zephyr Productions, Inc., 3 pp. (2003).

Final Office action from the U.S. Patent and Trademark Office for U.S. Appl. No. 12/730,125, dated Jun. 21, 2011.

Final Office action from the U.S. Patent and Trademark Office in U.S. Appl. No. 13/653,298, dated May 6, 2013.

Final Office action from the U.S. Patent and Trademark Office in U.S. Appl. No. 13/973,875, dated Apr. 17, 2014.

Information Disclosure Statement (Jul. 7, 2005), U.S. Appl. No. 95/000,085, filed Mar. 29, 2005, 2pp.

Inter Partes Reexamination Communication, Notice of Intent to Issue Inter Partes Reexamination Certificate (Feb. 13, 2008), App. No. 95/000,085, filed Mar. 29, 2005, 5pp.

Inter Partes Reexamination Communication, Notice re Defective Paper in Inter Partes Reexamination (Nov. 24, 2004), App. No. 95/000,040, filed Apr. 21, 2004, 4pp.

Mass, Weight, Density or Specific Gravity of Different Metals, http://www.simetric.co.uk/si_metals.htm, author and date unknown.

Notice of Allowability (Apr. 16, 2003), U.S. Appl. No. 09/878,634, filed Jun. 11, 2001 (cited in U.S. Appl. No. 95/000,040), 3pp.

Notice of Allowability (Sep. 30, 2011), U.S. Appl. No. 12/975,116, filed Dec. 21, 2010, 10pp.

Notice of Allowance from the U.S. Patent and Trademark Office in U.S. Appl. No. 13/349,494, dated Jul. 2, 2012.

Office action (Non-final) (Mar. 30, 2004), U.S. Appl. No. 10/316,453, filed Dec. 11, 2002, 14pp. (from abandoned parent of 83079-01 filed by Sheppard Mullin).

Office action (Final) (Dec. 9, 2004), U.S. Appl. No. 10/316,453, filed Dec. 11, 2002, 11pp. (from abandoned parent of 83079-01 filed by Sheppard Mullin).

(56) References Cited

OTHER PUBLICATIONS

Office action (Non-final) (Apr. 7, 2005), U.S. Appl. No. 10/941,474, filed Sep. 15, 2004, 10pp. (from parent case U.S. Pat. No. 7,041,005).
Office action (Non-final) (Dec. 3, 2002), U.S. Appl. No. 09/878,634, filed Jun. 11, 2001, 6pp. (from U.S. Pat. No. 6,623,378).
Office action (Non-final) (Jun. 22, 2009), U.S. Appl. No. 12/253,005, filed Oct. 16, 2008, 12pp. (from 83080-02).
Office action (Non-final) (Aug. 13, 2007), U.S. Appl. No. 11/401,472, filed Apr. 10, 2006, 5pp. (from 83080-01).
Office action (Final) (Mar. 19, 2008), U.S. Appl. No. 11/401,472, filed Apr. 10, 2006, 7pp. (from 8308001).
Office action (Non-final) (Mar. 19, 2009), U.S. Appl. No. 11/775,197, filed Jul. 9, 2007, 18pp. (from 83079-01).
Office action (Non-final) (Feb. 19, 2010), U.S. Appl. No. 11/775,197, filed Jul. 9, 2007, 18pp. (from 83079-01).
Office action (Non-final) (Dec. 7, 2010), U.S. Appl. No. 12/730,125, filed Mar. 23, 2010, 10pp. (from 83080-03).
Office action (Non-final) (Feb. 28, 2011), U.S. Appl. No. 12/975,116, filed Dec. 21, 2010, 21pp. (from 83079-02).
Office action from the U.S. Patent and Trademark Office in U.S. Appl. No. 13/349,494, dated May 21, 2012.
Office action from the U.S. Patent and Trademark Office in U.S. Appl. No. 13/653,298, dated Jan. 17, 2013.
Office action from the U.S. Patent and Trademark Office in U.S. Appl. No. 13/973,875, dated Jan. 1, 2014.
Order Granting/Denying Request for Inter Partes Reexamination (Jul. 15, 2004), App. No. 95/000,040, filed Apr. 21, 2004, 4pp.
Office action in Inter Partes Reexamination (Jul. 15, 2004), App. No. 95/000,040, filed Apr. 21, 2004, 10pp.
pp. 363-366 of Reexam Request No. 95/000,040 concerning U.S. Pat. No. 6,623,378 to Beach et al., date unknown, 4pp.
Petrie, Edward, "Handbook of Adhesives and Sealants," McGraw-Hill Companies, pp. 105-106 (2000).
Proposed R&A/USGA COR Solution, http://www.randa.org/rules/equipment/noticeDetails/1, author unknown (May 2002).
Properties and Performance of Polymer-Matrix Composites (ASM Metals Handbook Online, ASM International, 2003), Thermoset-Matrix, Composites.
Response to Office action Mailed Jul. 15, 2004 (Sep. 15, 2004), U.S. Appl. No. 95/000,040, filed Apr. 21, 2004, 10pp.
Resubmission of Response to Office action Mailed Jul. 15, 2004 in Response to Nov. 24, 2004 Inter Parties Reexamination Communication (Dec. 7, 2004), App. No. 95/000,040, filed Apr. 21, 2004, 11pp.
Response to Office action Mailed Sep. 21, 2004 (Nov. 21, 2005), U.S. Appl. No. 95/000,040, filed Apr. 21, 2004, 10pp.
Response to Office action Mailed Jun. 3, 2005 (Aug. 3, 2005), U.S. Appl. No. 95/000,085, filed Mar. 29, 2005, 6pp.
Resubmission of Response to Office action Mailed Jun. 3, 2005 in Response to Sep. 30, 2005 Inter Parties Reexamination Communication (Oct. 28, 2005), App. No. 95/000,085, filed Mar. 29, 2005, 9pp.
Submission of Prior Art and Request for Inter Partes Reexamination (Mar. 29, 2005), U.S. Pat. No. 6,872,152, issued Mar. 29, 2005 (cited in 95/000,085), 16pp.
Submission of Prior Art Under 37 CFR 1.902 and Request for Inter Partes Reexamination (Apr. 21, 2004), U.S. Pat. No. 6,623,378, issued Sep. 23, 2003 (cited in 95/000,040), 16pp.
Third Party Requester Comments to Office action and Patent Owner's Response Thereto (Dec. 16, 2005), U.S. Appl. No. 95/000,040, filed Apr. 21, 2004, 11pp.
Third Party Requester Comments to Office action and Applicant's Response Thereto (Oct. 14, 2004), U.S. Appl. No. 95/000,040, filed Apr. 21, 2004, 30pp.
Third Party Requester Comments to Office action and Patent Owner's Response Thereto (Sep. 1, 2005), U.S. Appl. No. 95/000,085, filed Mar. 29, 2005, 12pp.
Third Party Requester Comments to Office action and Patent Owner's Resubmitted Response Thereto (Nov. 15, 2005), U.S. Appl. No. 95/000,085, filed Mar. 29, 2005, 3pp.
Transmittal of Communication to Third Party Requester Inter Partes Reexamination, Office action in Inter Partes Reexamination (Sep. 21, 2005), App. No. 95/000,040, filed Apr. 21, 2004, 10pp.
Transmittal of Communication to Third Party Requester Inter Partes Reexamination, Action Closing Prosecution (Jan. 24, 2007), App. No. 95/000,040, filed Apr. 21, 2004, 12pp.
Transmittal of Communication to Third Party Requester Inter Partes Reexamination, Right of Appeal Notice (Sep. 20, 2007), App. No. 95/000,040, filed Apr. 21, 2004, 26pp.
Transmittal of Communication to Third Party Requester Inter Partes Reexamination, Notice of Intent to Issue Inter Partes Reexamination Certificate (Nov. 26, 2007), App. No. 95/000,040, filed Apr. 21, 2004, 4pp.
Transmittal of Communication to Third Party Requester Inter Partes Reexamination, Office action in Inter Partes Reexamination (Jun. 3, 2005), App. No. 95/000,085, filed Mar. 29, 2005, 13pp.
Transmittal of Communication to Third Party Requester Inter Partes Reexamination, Order Granting/Denying Request for Inter Partes Reexamination (Jun. 3, 2005), App. No. 95/000,085, filed Mar. 29, 2005, 10pp.
Transmittal of Communication to Third Party Requester Inter Partes Reexamination, Notice re Defective Paper in Inter Partes Reexamination (Sep. 30, 2005), App. No. 95/000,085, filed Mar. 29, 2005, 5pp.
Transmittal of Communication to Third Party Requester Inter Partes Reexamination, Action Closing Prosecution (Jan. 25, 2007), App. No. 95/000,085, filed Mar. 29, 2005, 16pp.
Transmittal of Communication to Third Party Requester Inter Partes Reexamination, Right of Appeal Notice (Aug. 17, 2007), App. No. 95/000,085, filed Mar. 29, 2005, 28pp.

* cited by examiner

GOLF CLUB HEAD HAVING A COMPOSITE CROWN

CROSS REFERENCE TO RELATED APPLICATIONS

This application is a continuation of U.S. patent application Ser. No. 13/973,875, filed Aug. 22, 2013, which is a continuation of U.S. patent application Ser. No. 13/653,298, filed Oct. 16, 2012, now U.S. Pat. No. 8,568,248, which is a continuation of U.S. patent application Ser. No. 13/349,494, filed Jan. 12, 2012, now U.S. Pat. No. 8,287,402, which is a continuation of U.S. patent application Ser. No. 12/975,116, filed Dec. 21, 2010, now U.S. Pat. No. 8,096,896, which is a divisional of U.S. patent application Ser. No. 11/775,197, filed Jul. 9, 2007, now U.S. Pat. No. 7,854,364, which is a continuation-in-part of U.S. patent application Ser. No. 10/316,453, filed Dec. 11, 2002, now abandoned, all of which are hereby incorporated by reference.

BACKGROUND

The invention relates generally to a wood-type golf club head and, more particularly, to a golf club head having a lightweight crown.

A wood-type golf club head includes a load-bearing outer shell with an integral or attached strike plate. Today's club head is typically formed of metal material and has a hollow cavity. The metal body may comprise several portions welded together or may include a cast body with a separate sole plate or strike plate that is welded in the appropriate location.

Most club heads today are made of a strong, yet lightweight metal material such as, for example, a titanium, steel or aluminum alloy. There have also been heads fanned of carbon fiber composite material. The use of these materials is advantageous for the larger club heads now sought by golfers, i.e., at least 300 cc and up to about 500 cc in volume. The larger sized, yet conventionally weighted, club heads strive to provide larger "sweet spots" on the striking face and club moments of inertia that, for some golfers, make it easier to get a golf ball up in the air and with greater accuracy.

Various attempts have been made to attain an improved coefficient-of-restitution ("COR") for golf club heads, with much attention paid to the design of face plates having variable thickness. However, the durability of very thin portions of the face plate continues to be a problem. Such face plate designs are limited by the high impact loads to which these club heads are subject, in particular at the junctions of the face plate with the crown and sole of the club head.

Titanium alloys are particularly favored in club head designs for their combination of strength and light weight. However, the material can be quite costly. Steel alloys are more economical; however, since the density of steel alloys is greater than for titanium alloys, steel club heads are limited in size in order to remain within conventional head weights while maintaining durability.

Composite club heads, such as a carbon fiber reinforced epoxy or carbon fiber reinforced polymer, for example, are an alternative to metal club heads. A notable advantage is the relatively light weight compared to stainless steel alloys. However, these club heads have suffered from durability and performance qualities associated with composite materials. These include higher labor costs in manufacture, undesirable acoustic properties of the composite material, shearing and separation of the layers of composite plies used to form the striking surface of the club head and relatively low COR for composite faces.

The areas of the club head that are subject to the greatest wear, the face and sole, have been reinforced in some instances by providing a metal plate in one or both regions. Integrated face and hosel constructions have also been done. However, durability at the junctions of the composite and metal materials continues to be a problem. Further, when the majority of the body of the club head is of composite material, there may still remain the problem of adequately fixing one or more weighting elements within the head body. The mere increase in volume of the club head may not provide the proper location of the center of gravity of the club head for greater forgiveness in off-center hits.

With regard to hybrid metal-composite club heads, U.S. Pat. Nos. 5,328,176, 5,410,798, and 5,624,331 to Kun-Nan Lo disclose composite-metal golf club heads having a metal casing with an inner member or core of composite material. The inner member reinforces the thin walls of the metal casing in U.S. Pat. Nos. 5,410,798 and 5,624;331. The crown comprises one or two carbon fiber composite portions. The single composite crown portion of U.S. Pat. No. 5,410,798 is attached to the upper ends of the composite member during the heating portion of the manufacturing process. The double composite crown portions of U.S. Pat. No. 5,624,331 are separated by a reinforcing central rib of the metal casing. U.S. Pat. No. 5,328,176 discloses a metal reinforcing plate that is fixed to the front face and wraps around the composite head from front to back.

Published U.S. Patent Application No. 2002/0049310 to Cheng et al. discloses a metal golf club head having a carbon-fiber cover that incorporates the entirety of the upper wail and a majority of the side walls at the toe, rear and heel ends of the head body. The position of the center of gravity of the head is accomplished by the size and placement of weight plugs in the sole and rear side wall. The attachment of the carbon-fiber cover is accomplished by insertion of a bladder through the hole for the plug in the sole and application of aluminum oxide sand where the carbon-fiber cover contacts the metal base and face of the head. The bladder is inflated, and the aluminum-oxide sand adhesively attaches the cover to the rest of the club head during a heating process.

Published Japanese Application No. 05-317465 discloses a golf club head having a hole cut into the crown part. The hole may be closed with a plate of a transparent and lightweight resin. This device allows the weight of the replaced metal material to be substantially distributed to the sale, lowering the center of gravity. An initial speed of a ball is increased and an amount of spin can be decreased, whereby distance can be increased.

Metal, composite and hybrid metal-composite club heads have long suffered from poor acoustic properties. That is, golfers are accustomed to—and desire—a particular range in pitch tone generated by the golf ball impacting the striking face. Some prior club heads have used a foam filling in order to alter the sound while attempting to minimize any adverse impact on performance. While metal club heads have become better matched to golfers' acoustic preferences, composite club heads generally lack acoustic appeal.

It should, therefore, be appreciated, there is a need for a golf club head having a high COR and improved durability and acoustic qualities, which is cost effective and simple to manufacture. The present invention fulfills this need and others.

SUMMARY

Described below are embodiments of a golf club head having a high COR that is durable and has desirable acoustic qualities. The club head includes a body portion, a striking face and a crown forming a hollow cavity of at least 150 cc in volume. The body portion defines a front opening and an upper opening, and it includes a sale and a side section that extends rearward of the front opening. The body portion preferably includes a recessed support extended from a shoulder and positioned adjacent to the upper opening to support the crown. The striking plate is secured to the body portion, enclosing the front opening. The crown is secured to the body portion, enclosing the upper opening. The crown has a maximum thickness no greater than about 2 mm. The density of the crown is less than the density of the body portion. At least one of the striking plate and the crown is attached to the second portion by adhesive bonding, and the golf club head has a maximum coefficient of restitution of at least 0.80.

In a detailed aspect of a preferred embodiment, the body portion is preferably formed of a metal having a density of at least about 1.8 g/cc and preferably at least about 4 g/cc. The crown has a density between 1 g/cc and 2 g/cc.

In another detailed aspect of a preferred embodiment, the crown is formed of plies of composite material having a fiber areal weight of between 20 g/m$^2$ and 200 g/m$^2$. The weight of the composite crown being at least 20% less than the weight of a similar sized piece formed of the metal of the body. The composite crown may be formed of an uppermost ply and at least one layer of four plies of uni-tape standard modulus graphite, the plies of uni-tape oriented at any combination of 0°, +45°, −45° and 90°.

In yet another detailed aspect of a preferred embodiment, the crown includes a first portion sized to sit on a recessed support of the body such that a side edge of the first portion is proximate to the shoulder of the body portion, thereby forming a junction between the first portion of the crown and the body portion. Moreover, at least one of the side edge of the first portion and the shoulder of body portion can have a tapered profile thereby forming a depression about the junction. A surface veil is secured atop the junction, at least partially filling the depression, if any.

In yet another detailed aspect of a preferred embodiment, the striking plate is separately formed and attached to the front of the body of the club head. At least one of the crown and striking plate is adhesively attached to the main body of the club head. The striking plate is made of metal and is welded to a cast second portion of the body having an opening at its front, with a lightweight crown adhesively bonded to the top opening of the body.

A method of manufacturing a golf club head having a maximum coefficient of restitution of at least 0.80 is also provided. The method includes forming a body potion of a metal material, the body having walls forming a front, a side section, a sole and a top section, an opening formed in each of the front and the top section. A striking plate adapted to enclose the front opening of the body is also formed. A crown is formed to enclose the opening in the top section. The crown has a density less than 2 g/cc and a maximum thickness no greater than 2 mm The striking plate is attached to the body portion, enclosing the front opening. At least one of the crown and the striking plate is attached to the body by adhesive bonding. The forming steps may be performed in any order, while the striking plate is attached prior to attachment of the crown to the body. The resulting access to the interior of the nearly complete golf club head allows final weighting and/or other members to be attached to any inner surface as desired.

For purposes of summarizing the invention and the advantages achieved over the prior art, certain advantages of the invention have been described herein above. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Embodiments of the present invention will now be described, by way of example only, with reference to the following drawings in which.

DETAILED DESCRIPTION OF PREFERRED EMBODIMENTS

Figure 1:
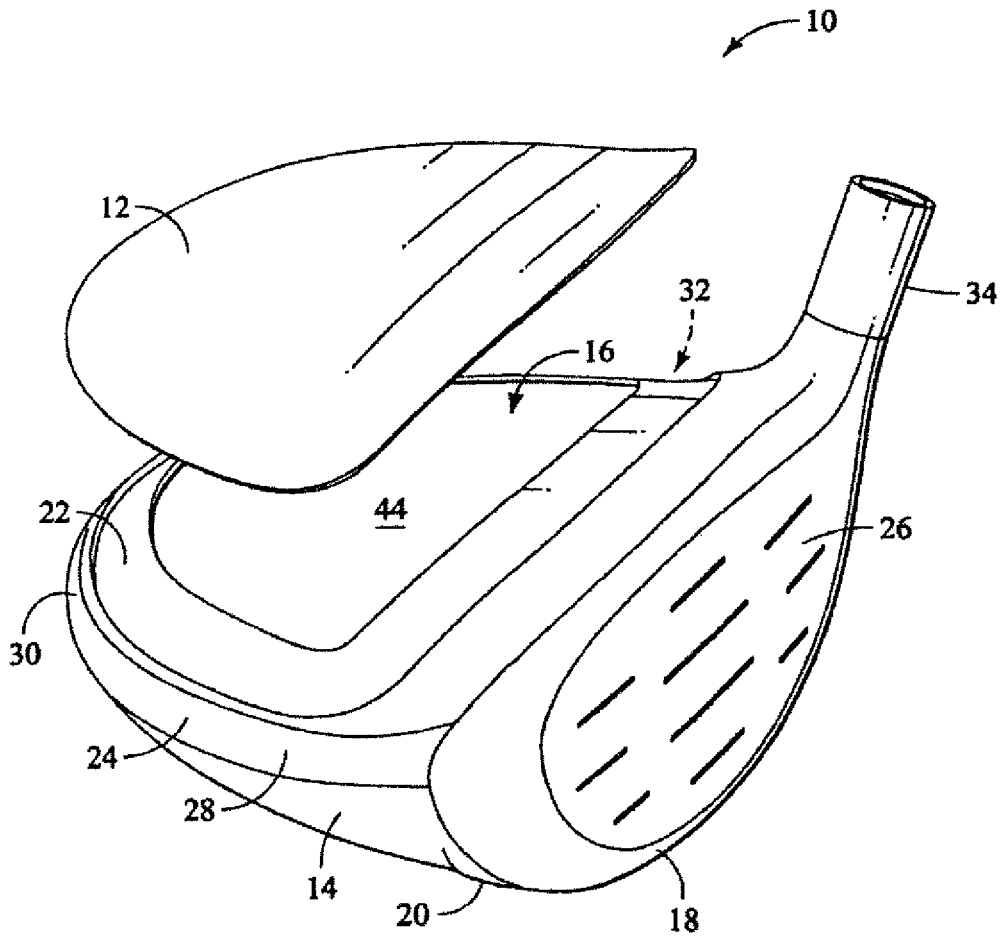
FIG. 1 is a partially exploded perspective view of a preferred embodiment of a club head in accordance with the invention, depicting a crown separated from a body portion.

With reference to the illustrative drawings, and particularly FIG. 1, there is shown a golf club head 10 having a crown 12 formed of composite material not yet attached to a body 14 of a golf club head, to enclose an opening 16. The body is formed of any metal, such as an aluminum, steel or titanium alloy, for example. The body may be cast to form a front 18, a sole 20, a top portion 22 and a side portion 24. At the front, a striking plate 26 is separately formed and attached to the front of the body in any manner known to those skilled in the art (see FIGS. 4 and 5). The striking plate may be formed of a different alloy or grade of the same metal as the body, or the plate may be a different metal or a composite material, as desired. If metallic, the striking plate is welded to the front 18; if made of a composite material, the striking plate may be adhesively bonded to the front 18.

In alternative embodiments, the metal body may comprise three or more portions welded together, where the portions are forged, cast or stamped pieces or any mix thereof. Or, the body may be cast except for a separate sole plate that is attached in the appropriate location. The body may also include one or more attached members, such as weighting elements, that may comprise a metal or other material having a different density than the material of the rest of the main body.

The side portion 24 extends rearwardly of the front 18 and has a toe region 28, a rear region 30 and a heel region 32 formed above the sole 20. A hosel 34 is provided at the heel end of the body for attachment of a shaft (not shown). The top portion 22 of the body 14 extends rearwardly from an upper edge 36 of the front 18 of the club head, above the side portion 24. Thus, the sole 20, top portion 22, front 18 and side portion combine with the crown 12 to form a hollow body having a volume of at least 150 cubic centimeters (cc) and up to 500 cc.

Figure 2:
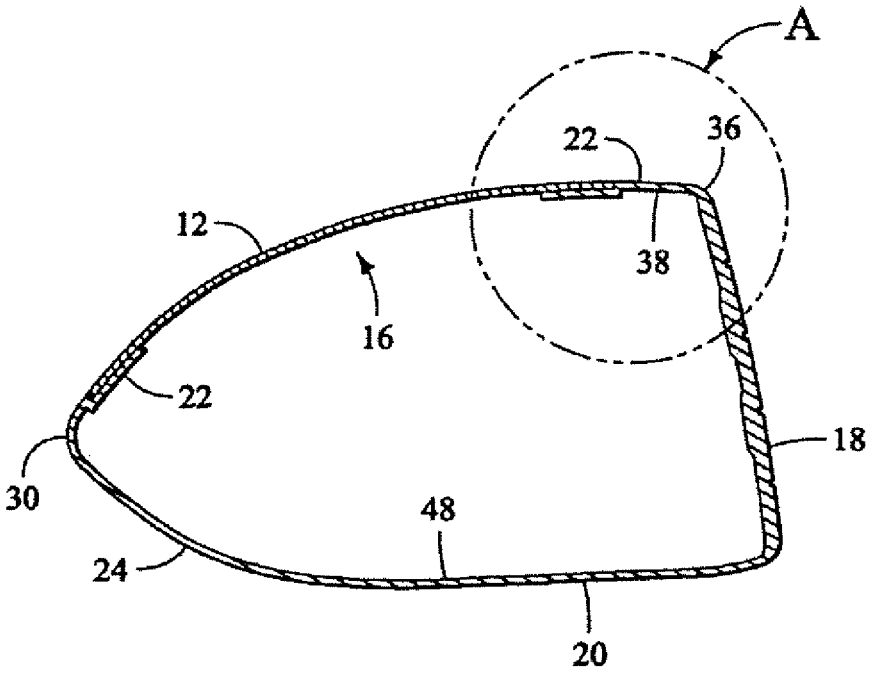
FIG. 2 is a cross-sectional view of the club head of FIG. 1, depicting the crown in place.

As more clearly shown in FIG. 2, the cast body 14 includes an annular rim 38 at the opening 16 in the top portion 22 that includes a ledge 40 that acts as a support member for the crown 12. Alternatively, the support member may comprise a plurality of tabs. The size and shape of the support member is preferably chosen to minimize the required overlap with the crown or the mating surface area of the crown and top portion.

Figure 3:
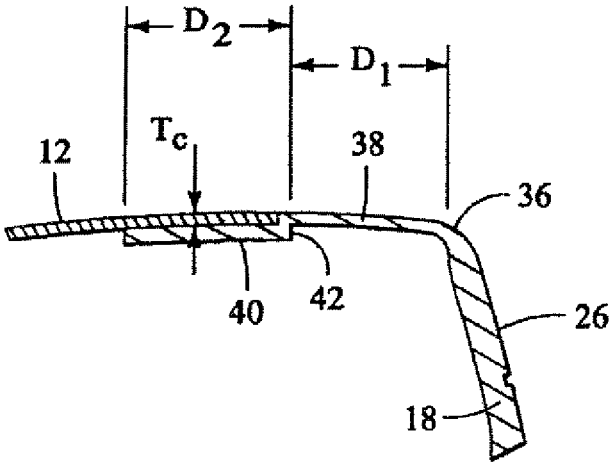
FIG. 3 is a cross-sectional view of a junction of the crown and body portion of the club head of FIG. 1.

Referring to FIG. 3, the rim 38 extends a distance $D_1$ of at least 7 mm rearward from the upper edge 36 of the front 18, with a shoulder 42 defining the ledge 40 which preferably extends an additional distance D, of at least 7 mm. The rim preferably extends between 8 mm and 12 mm, and more preferably about 10 mm, from the upper edge 36 while providing advantages of the present invention. Similarly, the ledge preferably extends between 8 mm and 12 mm, Preferably, an adhesive such as Hysol® two part epoxy 9460 or, alternatively, 3M® DP460NS, is used to attach the crown 12 onto the ledge 40, abutting the shoulder 42.

Figure 4:
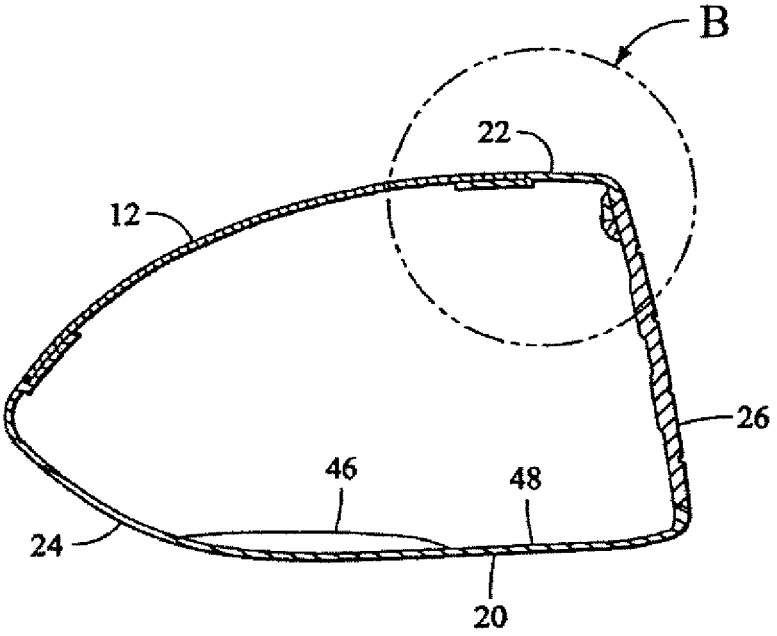
FIG. 4 is a cross-sectional view of a second preferred embodiment of a golf club head in accordance with the invention.
Figure 5:
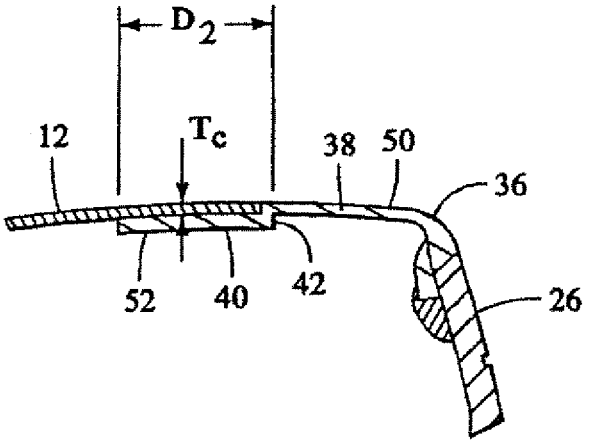
FIG. 5 is a cross-sectional view of a junction of the crown and the body portion of the club head of FIG. 4.

The striking plate 26 may be formed to have a rear surface with a flat portion 27*a* and a tapered portion 27*b*, such as are shown, e.g., in FIG. 4.

Figure 6:
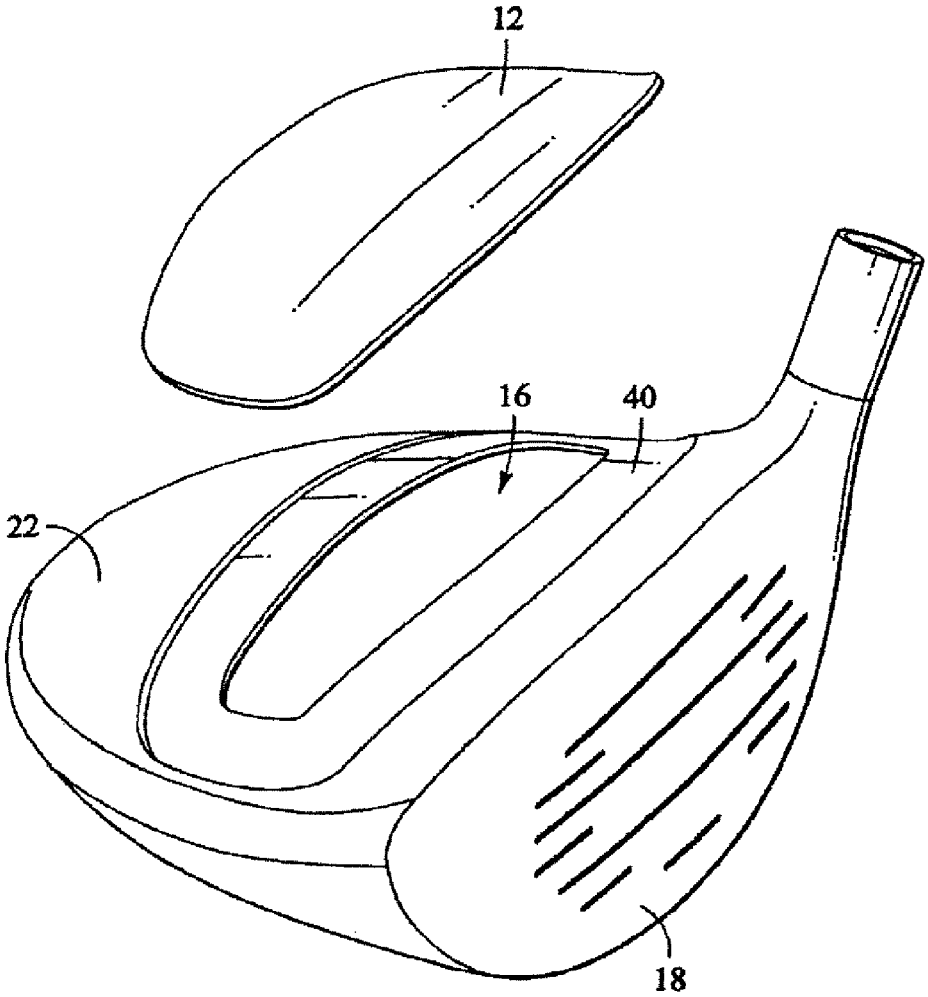
FIG. 6 is a partially exploded view of another preferred embodiment of a club head in accordance with the invention, depicting the composite crown separated from the metal body.

The opening 16 in a central section 44 of the top portion 22 comprises at least 25% (see FIG. 6), and preferably comprises at least 60%, of the total area of the top portion 22. More preferably, the opening is at least 75% of the total area of the top portion. Thus, there is a significant weight savings afforded by replacing a similarly sized metal crown with the crown 12 described herein. The difference in weight between the metal and composite materials may be redistributed in the club head 10 to manipulate the center of gravity of the club head, such as by providing a weight pad 46 on an interior surface 48 of the sole as shown in FIG. 4. Such a weight pad is preferably formed of material having a higher density (e.g., tungsten) than the material of the body 14 of the club head and is attached to the sale 20; although, a weight pad may alternatively be cast as a thickened portion of the sale.

Tables I and II show exemplary materials for the body 14 of the club head and the crown 12, respectively. The body 14 preferably has a thin-wall construction, wherein the thicknesses of the sole 20 and side portion 24 is in the range of 0.8 mm to 2 mm and the top portion thickness is in the range of 0.7 mm to 2 mm. The thickness of the front portion 26 is preferably in the range of 1.5 mm to 4 mm. The crown is also of a thin construction, having a thickness $T_c$ of no more than about 2 mm, preferably less than 1.5 mm, and more preferably about 1 mm. In the preferred embodiment of FIGS. 1-3, the thickness of the top portion 22, including the ledge 40, is approximately 1 mm so that the shoulder 42 extends about 2 mm from an outer surface 50 of the top portion to an inner surface 52 of the ledge.

TABLE I

EXAMPLES OF METALS FOR THE BODY OF A CLUB HEAD

| Material Type | Density (g/cc) | Ult. Tens. Str. (MPa) | Mod. of Elast. (GPa) | Hardness |
|---|---|---|---|---|
| Mg AZ81A-T4 | 1.8 | 275 | 45 | Brinell 55 |
| Al 1201 Alloy | 2.85 | 430 | 72 | — |
| Ti 6A1—4V | 4.43 | 950 | 113.8 | Brine1l334<br>Rockwell C 36 |
| Ti 15-3-3-3 | 4.76 | 790 | 82 | Rockwell B 95 |
| Carpenter Custom 455 ® | 7.76 | 1100 | 200 | Brinell 318<br>Rockwell C 34 |

TABLE II

EXAMPLES OF COMPOSITE MATERIALS FOR A CLUB HEAD CROWN

| Composite Fiber Material | Density (g/cc) | Ult. Tens. Str. (MPa) | Modulus of Elasticity (GPa) |
|---|---|---|---|
| Carbon Filled Nylon | 1.4 | 103 | 13 |
| DuPont Kevlar ® 49 Fiber, diam 11.9 um | 1.44-1.45 | 2760 | 120-125 |
| Thornel ® VCB-20 Carbon Cloth | 1.88 | 1380 | 138 |

A graphite-epoxy composite material, for example, with a 50% to 70% fiber volume ratio would have a density between about 1.4 g/cc and 1.65 g/cc.

A golf club head constructed in this manner advantageously improves durability since the junction of the striking plate 26 with the top portion 22 is subject to a lesser force at impact with a golf ball. The use of the crown 12 on the metal body 14 also increases COR. Further, the golf club head having a crown on a metal body advantageously provides acoustic qualities judged more appealing to golfers.

In one club head tested by the inventors, a 300 cc hollow body was formed of a stainless steel alloy. A large area, 1 mm thick crown was formed of five plies including four plies of a uni-tape of standard modulus graphite and one ply of a woven graphite cloth. The four plies of uni-tape were assembled at 0, 45, −45 and 90 degrees and had a fiber areal weight (FAW) of about 40 grams per meter squared ($g/m^2$). The standard modulus is approximately 33 Mpsi for the fiber with about 600 Kpsi tensile strength. In comparison, an alternative, and more expensive, ultrahigh modulus fiber (satellite grade) comprises about 57 Mpsi. FAW may range from about 20 to 200 $g/m^2$, and preferably the composite plies for the crown are in the range of 70 to 180 g/m$^2$. More preferably, the composite plies for the crown are in the range of 120 to 16Q g/m$^2$.

The resultant mass of the crown 12 is about 10 grams. This is about a 50% reduction in the mass compared to a crown formed of the steel material of the rest of the club head. The calculations of the weight savings must take into account the presence of the ledge 40 with the crown, as well as the adhesive. Generally, the weight savings is at least 20% compared to an all metal body. The weight pad 46 may then be added to achieve a total mass approximately equivalent to an all metal body.

The crown 12 may alternatively be formed of more or less plies, and instead of the top ply being a woven graphite cloth, the top ply may be another uni-tape that is painted to achieve the desired aesthetic look of the club head. The top ply is preferably oriented at 0 or 90 degrees. The molding of the crown may be performed using methods known to those skilled in the art and preferably comprises a matched mold to achieve a net shape that requires little finishing and flash removal prior to its attachment to the body 14 of the club head.

Another club head tested by the inventors utilized a titanium alloy body for the club head, with a crown 12 formed of a thermoplastic material. Preferably, the crown is an injection-molded nylon or polyphenylene sulfide (PPS) material, using 3M® DP460NS adhesive for attachment to the metal body. The nylon may be used with or without glass or carbon fiber and preferably has a density between 1 g/cc and 1.7 g/cc. Alternatively, the PPS material may be used with or without glass or carbon fiber and preferably has a density between 1.3 g/cc and 2.0 g/cc. Replacing the crown of the titanium alloy club head results in about 35% savings in weight. In general, the weight savings is at least 15% compared to an all metal body.

The replacement of the crown of a metal club head provides the advantage of weight savings and/or redistribution of mass to the sole, for example. A weight pad on the sole, or elsewhere on the body, may be integrally formed or be a separately formed and attached mass, the resulting weight being comparable to an all metal club head of the same volume.

Figure 7:
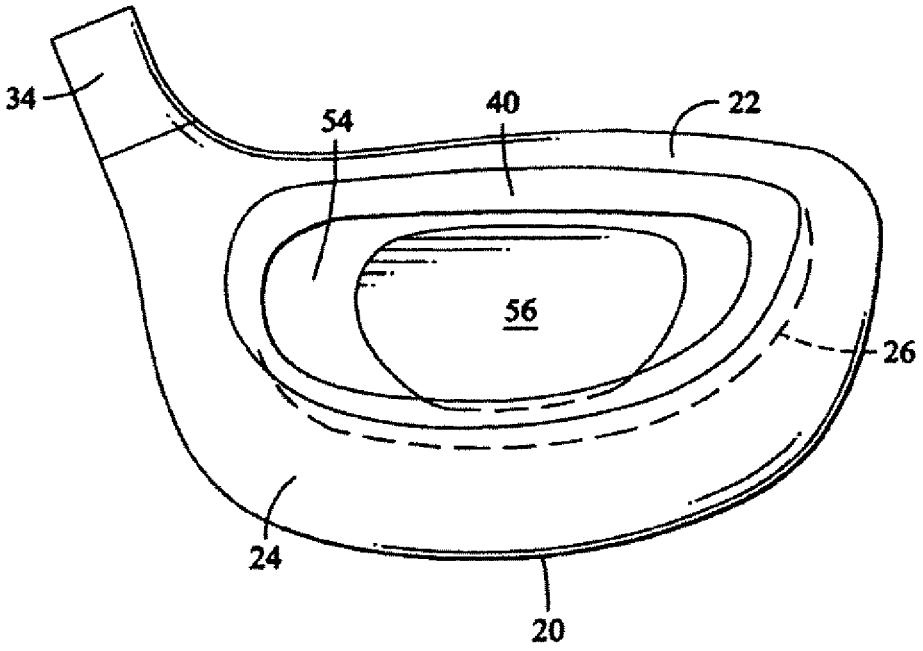
FIG. 7 is a perspective view of a striking face and a body portion of a preferred embodiment of a golf club head in accordance with the invention, depicting a rear surface of the striking face.

Because of the access afforded by the opening in the top of the club head, a rear of the striking face 54 is accessible during manufacture for the addition of a face reinforcing member 56 formed of metal or composite material and securely attached behind the sweet spot, as shown in FIG. 7. Thus, a thin titanium alloy striking face can be strengthened or otherwise enhanced in performance. Similarly, any number of additional members may be attached elsewhere on any inner surface of the club head.

The use of the aforementioned materials, composite or plastic, for the crown 12 allows the use of a lighter weight material that may result in the top of the club head having a stiffness similar to the heavier, metal sale. This stiffness matching may be advantageous for high COR golf club heads.

The golf club head 10 can be assembled with the aid of adhesive bonding. In a preferred method of manufacture, the striking face 22 is securely attached to the body 14, enclosing a front opening. While partially assembled, final weighting and/or other attachment of other members to the inner surface of the club head can be preformed, as desired. Next, the crown is secured in place, forming the top section of the club head. Preferably, the crown 12 is of a material having a density less than 2 g/cc and has a thickness no greater than 2 mm. At least one of the crown and the striking plate is attached by adhesive bonding to the opening in the body. In one embodiment, the mating surfaces of the crown and ledge 40 may be prepared by sandblasting to enhance bonding. Other steps may be performed in order to prepare and/or finish the final club head, as known to those skilled in the art.

Figure 8:
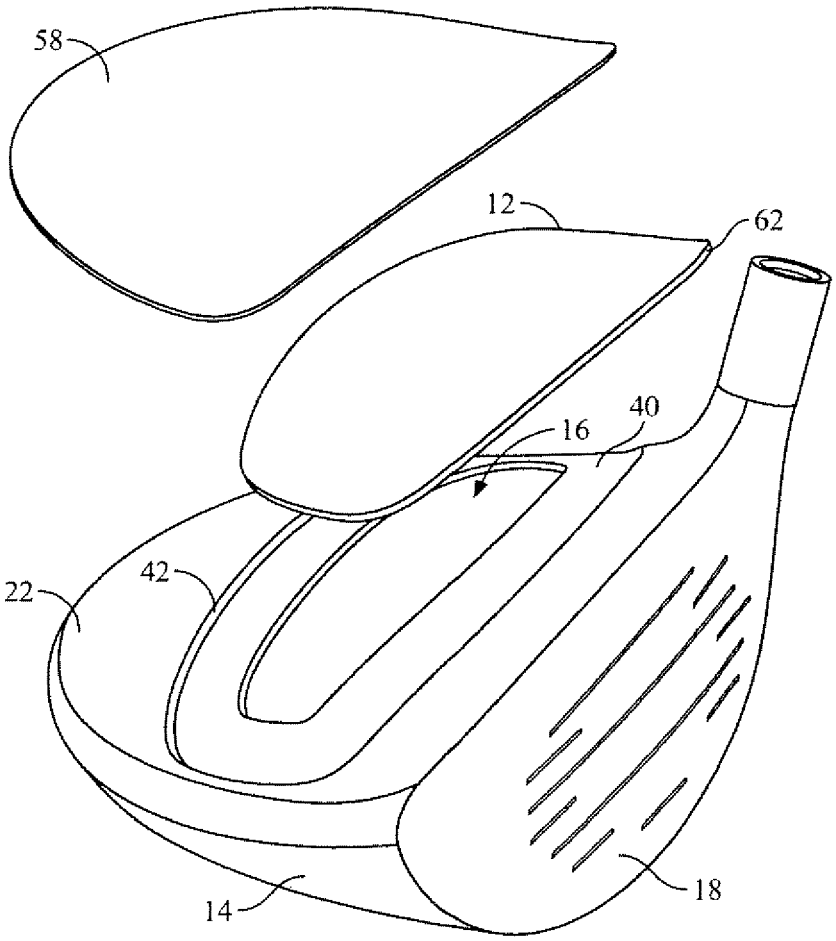
FIG. 8 is a partially exploded perspective view of a third preferred embodiment of a golf club head in accordance with the invention, depicting a crown, including a surface veil covering a top portion of the club head, separated from a body portion.
Figure 9:
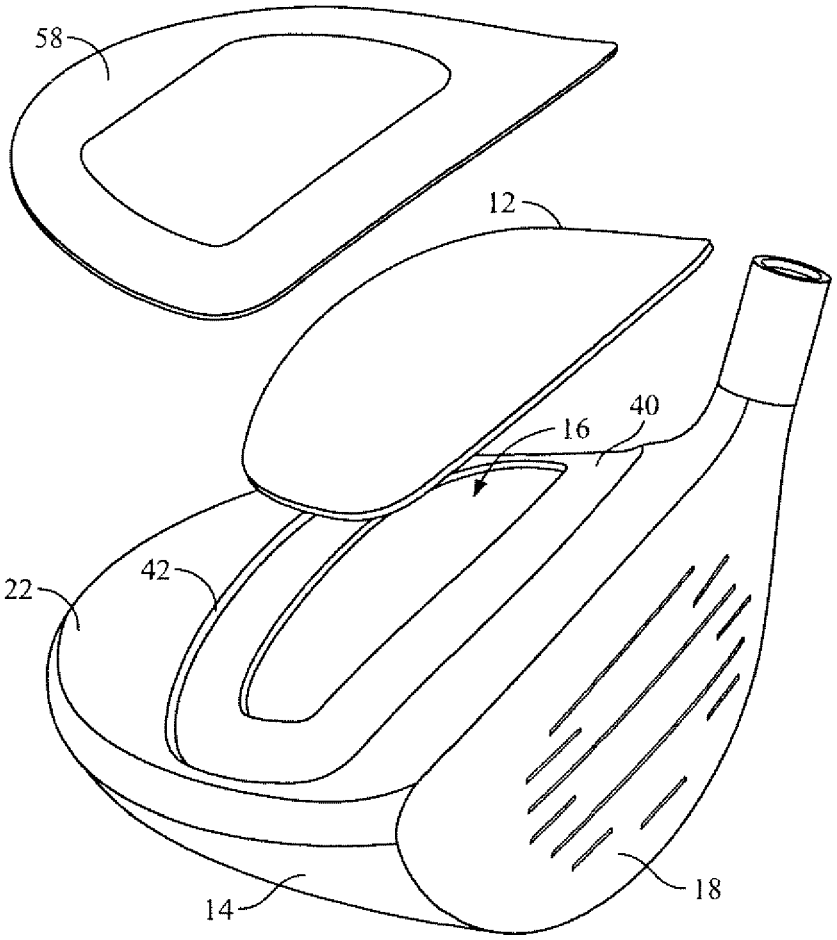
FIG. 9 is a partially exploded perspective view of a fourth preferred embodiment of a golf club head in accordance with the invention, depicting a crown, including a surface veil covering a junction between the crown and body portion, separated from a body portion.

With reference now to FIGS. 8 and 9, the golf club head may further include a surface veil 58 sized to cover the junction between the crown portion 12 and the body portion 14. The surface veil can include plies of composite material. As shown in FIG. 8, the surface veil can be sized to entirely cover the junction between the crown and body portion and the outer surface of the crown. Alternatively, as shown in FIG. 9, the surface veil can be configured to be disposed about the crown to cover the junction between the crown and the body portion. The surface veil aids in preventing cracking and peeling of the club head's surface. In the exemplary embodiments, the surface veil is formed of two additional plies of the material used with the crown portion, as discussed above. In other preferred embodiments, the crown portion is formed of a first lightweight material, as discussed above, e.g., carbon fiber plies, and the surface veil is formed of a second lightweight material, such as discussed above, e.g., a glass composite.

Figure 10A:
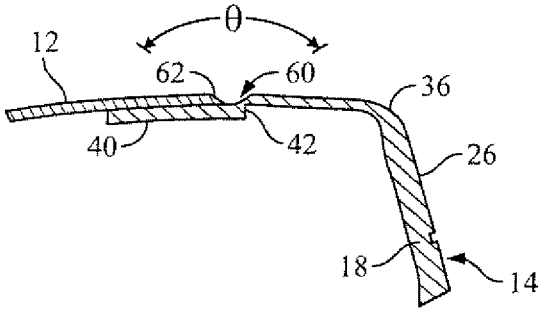
FIGS. 10A-10C are cross-sectional views of a junction of the crown and the body portion of the club head of FIG. 9, depicting exemplary steps for applying the surface veil.
Figure 10B:
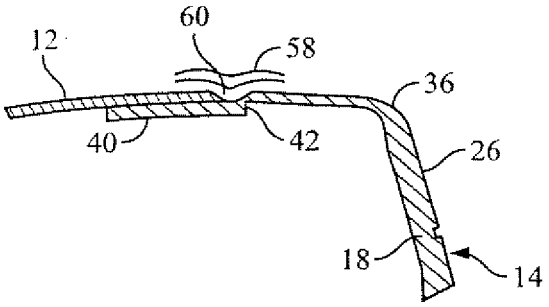
Figure 10C:
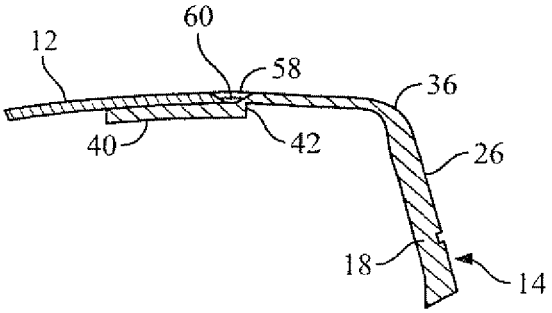

With reference now to FIGS. 10A-10C, an exemplary method of attaching the surface veil 58 is depicted. As shown in FIG. 10A, an obtuse depression 60 is provided at the junction between the crown portion 12 and the body portion 14. The depression is preferably formed by providing a taper to at least one of the side edge 62 of the crown portion and the shoulder 42 of the body portion. In the exemplary method, both the side edge and the shoulder are tapered, defining an angle θ, which is preferably greater than 90 degrees and less than 180 degrees. The surface veil is attached above the junction such that it at least partially fills the depression (FIG. 10B). Once in place, the outer surface of the club head undergoes additional treatment, e.g., grinding and/or sanding, to provide a smooth, finished surface (FIG. 10C).

It should be appreciated from the foregoing the present invention provides a golf club head having a high COR that is durable and has desirable acoustic qualities. The club head includes a body portion, a striking face and a crown forming a hollow cavity of at least 150 cc in volume. The body portion defines a front opening and an upper opening, and it includes a sole and a side section that extends rearward of the front opening. The striking plate is secured to the body portion, enclosing the front opening. While partially assembled, final weighting and/or other attachment of other members to the inner surface of the club head can be performed, as desired. The crown is secured to the body portion, enclosing the upper opening. A surface veil may also be provided about a junction of the crown and body. The crown has a maximum thickness no greater than about 2 mm. The density of the crown is less than the density of the body portion. Beneficially, the golf club head has a coefficient of restitution of at least 0.80.

Although the invention has been disclosed in detail with reference only to the preferred embodiments, those skilled in the art will appreciate that additional golf club heads can be made without departing from the scope of the invention. Accordingly, the invention is defined only by the claims set forth below.

We claim:

1. A golf club head, comprising:

a body having a sole, a front, a top portion defining an upper opening, and a side portion, the side portion extending rearward of the front and having toe, rear, and heel regions, wherein the body is comprised of a metallic material having a density of at least about 4 g/cc, the upper opening located solely in the top portion of the body and comprising at least 25% of the total area of the top portion;

a support member located solely in the top portion of the body and surrounding the upper opening; and a crown supported by and secured to the support member, thereby enclosing the upper opening, a first portion of the crown being sized to sit on the support member such that the first portion overlaps at least a portion of the support member, thereby forming a junction between the first portion of the crown and the body portion, the crown incorporating composite material and having a density between 1 g/cc and 2 g/cc, the crown having a maximum thickness no greater than about 2 mm and formed of plies of composite material having a fiber areal weight that ranges from about 20 $g/m^2$ to 200 $g/m^2$;

wherein the golf club head has a maximum coefficient of restitution of at least 0.80 and a volume of at least 150 cc.

2. The golf club head of claim 1, wherein the body is integrally formed.

3. The golf club head of claim 1, wherein the support member is located on an annular lip.

4. The golf club head of claim 3, wherein a shoulder is arranged adjacent to at least a front portion of the annular lip.

5. The golf club head of claim 4, wherein the first portion of the crown is sized to abut and cover the annular lip of the body portion such that a side edge of the first portion is proximate to the shoulder, thereby forming the junction between the first portion of the crown and the body portion.

6. The golf club head of claim 4, wherein the shoulder is a distance (D1) of at least 7 mm rearward from the front of the golf club head.

7. The golf club head of claim 1, wherein the volume is at least 350 cc.

8. The golf club head of claim 1, wherein the upper opening comprises at least 60% of the total area of the top portion of the body portion.

9. The golf club head of claim 1, wherein the upper opening comprises at east 75% of the total area of the top portion of the body portion.

10. The golf club head of claim 1, wherein the fiber areal weight of the plies of composite material from which the crown is formed in the range of 70 $g/m^2$ to 180 $g/m^2$.

11. A golf club head, comprising:

a body having a sole, a front, a top portion defining an upper opening, and a side portion, the side portion extending rearward of the front and having toe, rear, and heel regions, wherein the body is comprised of a metallic material having a density of at least about 4 g/cc, the upper opening located solely in the top portion of the body and comprising at least 25% of the total area of the top portion;

a support member located solely in the top portion of the body and surrounding the upper opening; and a crown supported by and secured to the support member, thereby enclosing the upper opening, a first portion of the crown being sized to sit on the support member such that the first portion overlaps at least a portion of the support member, thereby forming a junction between the first portion of the crown and the body portion, the crown incorporating composite material and having a density between 1 g/cc and 2 g/cc, the crown having a maximum thickness no greater than about 2 mm and wherein the crown is formed of plies of composite material having a fiber areal weight in the range of 70 $g/m^2$ to 180 $g/m^2$;

wherein the golf club head has a maximum coefficient of restitution of at least 0.80 and a volume of at least 150 cc.

12. The golf club head of claim 11, further comprising a striking plate attached to the body and comprised of a metallic material.

13. The golf club head of claim 12, further comprising a face-reinforcing member coupled to a rear surface of the striking plate.

14. The golf club head of claim 13, wherein e face-reinforcing member comprises composite material.

15. The golf club head of claim 14, wherein the crown portion is adhesively secured to the body portion using one of two part epoxy and an adhesive.

16. The golf club head of claim 11, wherein the body is integrally formed and the volume is at least 350 cc.

17. The golf club head of claim 11, wherein the crown is comprised of at least four plies of uni-tape modulus graphite.

18. The golf club head of claim 17, wherein the at least four plies being oriented at an combination of 0° , +45° , −45° and 90°.

19. The golf club head of claim 17, further comprising uppermost ply of woven graphite cloth.

20. A golf club head comprising:

a body including a front portion, a back portion, a top portion defining an upper opening, a side portion, the side portion extending rearward of the front and having toe, rear, and heel regions, and a sole portion, an upper edge being defined between the front portion and the top portion, the upper opening located solely in the top portion of the body and a support member located solely in the top portion of the body and surrounding the upper opening;

a crown secured to the top portion and covering the upper opening and the support member, a first portion of the crown being sized to abut the support member such that the first portion overlaps the support member and is joined to the support member by adhesive thereby forming a junction between the first portion of the crown and the body portion, the crown incorporating composite material and having a density between 1 g/cc and 2 g/cc, the crown having a maximum thickness no greater than about 2 mm and wherein the crown is formed of plies of composite material having a fiber areal weight in the range of 70 $g/m^2$ to 180$g/m^2$; and a shoulder extending adjacent to at least a frontward portion of the support member, the shoulder being a distance (D1) of at least 7 mm rearward from the upper edge.

* * * * *